US005416974A

United States Patent [19]

Wain

[11] Patent Number: 5,416,974

[45] Date of Patent: May 23, 1995

[54] SAFETY RAZORS AND BLADE UNITS THEREFOR

[75] Inventor: Kevin J. Wain, Woodley Reading, United Kingdom

[73] Assignee: The Gillette Company, Boston, Mass.

[21] Appl. No.: 920,317

[22] PCT Filed: Mar. 22, 1991

[86] PCT No.: PCT/US91/01926

§ 371 Date: Nov. 12, 1992

§ 102(e) Date: Nov. 12, 1992

[87] PCT Pub. No.: WO91/14546

PCT Pub. Date: Oct. 3, 1991

[30] Foreign Application Priority Data

Mar. 27, 1990 [GB] United Kingdom ..... 9006782

[51] Int. Cl.[6] ..... B26B 21/16

[52] U.S. Cl. ..... 30/50; 30/57

[58] Field of Search ..... 30/49, 50, 51, 57, 77, 30/78

[56] References Cited

U.S. PATENT DOCUMENTS

| | | | |
|---|---|---|---|
| 4,063,354 | 12/1977 | Oldroyd et al. | 30/47 |
| 4,184,246 | 1/1980 | Trotta | 30/47 |
| 4,200,976 | 5/1980 | Gooding | 30/47 |
| 4,275,498 | 6/1981 | Ciaffone | 30/47 |
| 4,335,508 | 6/1982 | Francis et al. | 30/47 |
| 4,337,575 | 7/1982 | Trotta | 30/47 |
| 4,443,940 | 4/1984 | Francis et al. | 30/50 |
| 4,516,321 | 5/1985 | Francis | 30/50 |
| 4,586,255 | 5/1986 | Jacobson | 30/41 |
| 4,709,477 | 12/1987 | Ferraro | 30/50 |
| 4,932,122 | 6/1990 | Shurland | 30/50 |
| 5,224,267 | 7/1993 | Simms et al. | 30/50 |
| 5,251,376 | 11/1993 | Althaus et al. | 30/50 |

*Primary Examiner*—Hwei Siu Payer
*Attorney, Agent, or Firm*—Donal B. Tobin

[57] ABSTRACT

A safety razor head comprises a head frame (101) carrying a cap member (104) and two blade units (105) all mounted in slots in end walls (103) of the frame (101) so as to be movable vertically, i.e. towards and away from the base (102) of the frame. The movable elements are urged upwardly by springs (106). The blade units (105) comprise metal pressing (108) of inverted L-shaped cross-section. Blade members (107) are attached to the top limbs (109) and guard portions (111, 112) are spaced forwardly of the blade edges (107A). The pressing (108) has projecting ears (114) at opposite ends by which each unit is mounted in the frame (101) for limited pivotal movement about an axis parallel with and close to the blade edge (107A).

6 Claims, 5 Drawing Sheets

SAFETY RAZORS AND BLADE UNITS THEREFOR

This invention relates to safety razors and to blade units for incorporation in safety razors.

The invention aims at the provision of a safety razor having a high degree of "conformance", that is to say the ability to permit or constrain the skin-engaging elements of the razor to maintain optimum contact with the varying contours of the skin during a shaving operation.

In accordance with a feature of the present invention, a blade unit for a safety razor comprises a blade having a sharpened cutting edge and a blade support comprising a platform to which the blade is attached with its edge projecting forwardly of the platform, characterized in that the support further comprises an integral guard portion spaced forwardly of the blade edge, and mounting means on the support by which the integral guard and blade are mounted in use in a razor head, for rotation together about an axis parallel with and close to the blade edge.

The invention also includes a safety razor including a head frame in which at least one such blade unit is mounted for rotation about the said axis.

Preferably, the (or each) unit is also mounted for movement relative to the frame under forces encountered during shaving, against the action of a resilient restoring force, in directions transverse (i.e. substantially perpendicular) to a notional plane containing the blade edge and a skin engaging surface of the guard portion.

A blade unit and safety razor head frame in accordance with the invention and some modifications thereof, will now be described, by way of example, with reference to the accompanying drawings, in which.

Figure 1:
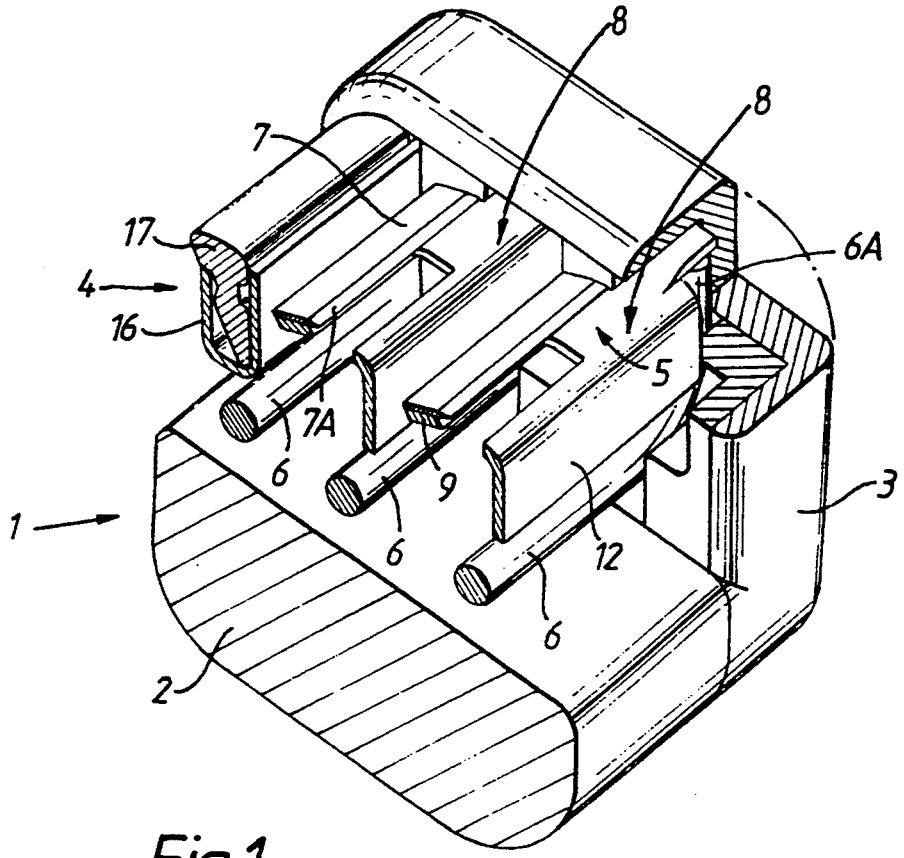
FIGS. 1 and 2 are perspective views of an end portion of the head frame and of a blade unit, respectively.
Figure 2:
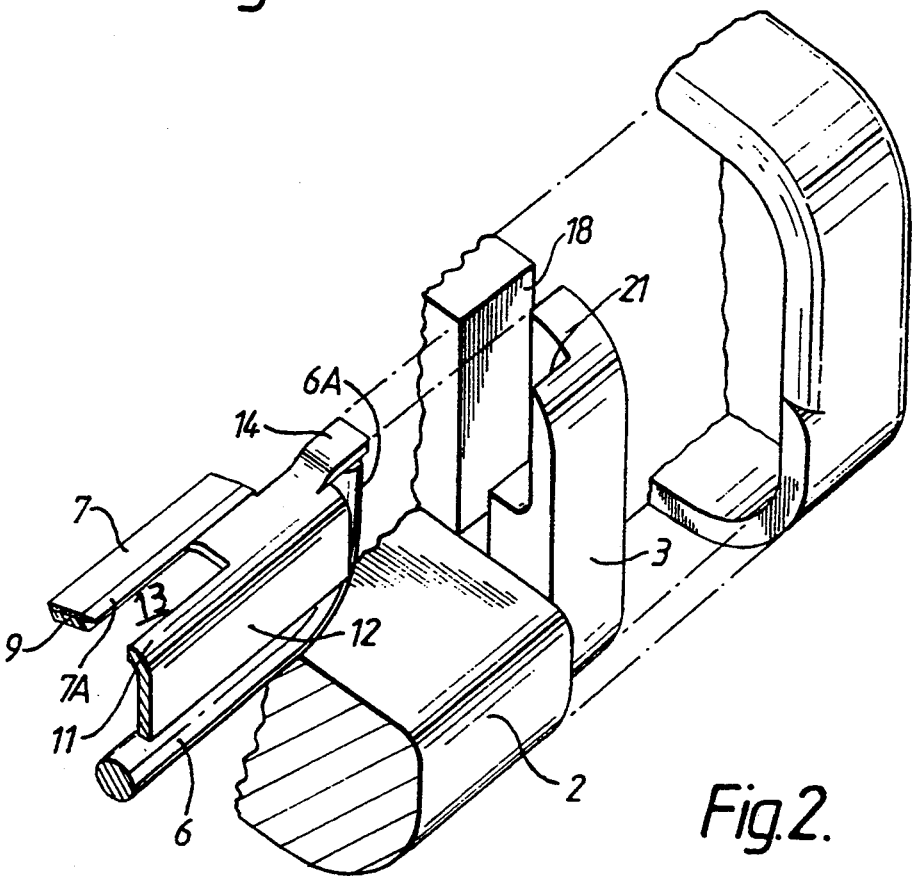
Figure 3:
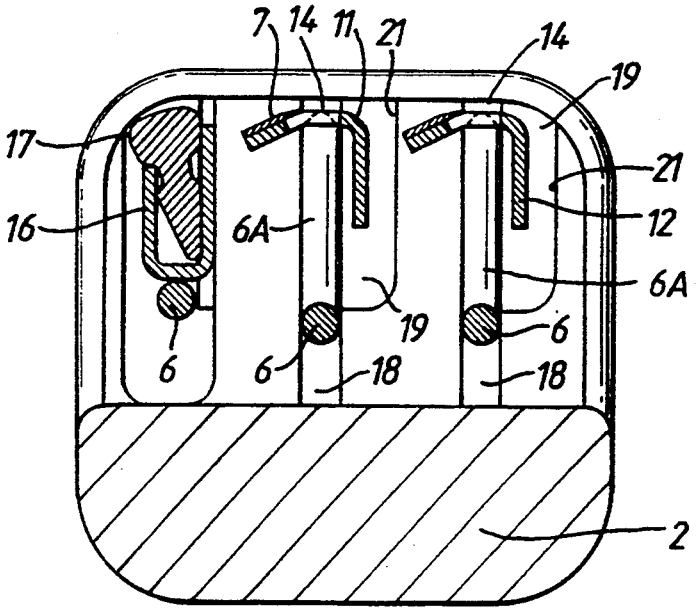
FIG. 3 is a cross-section taken at the sectioning line in FIG. 1, showing the blade units and a cap member in the normal positions of rest.
Figure 4:
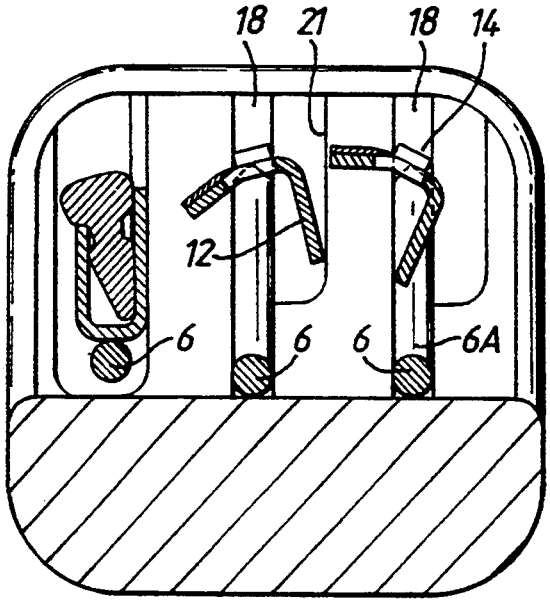
Figure 5:
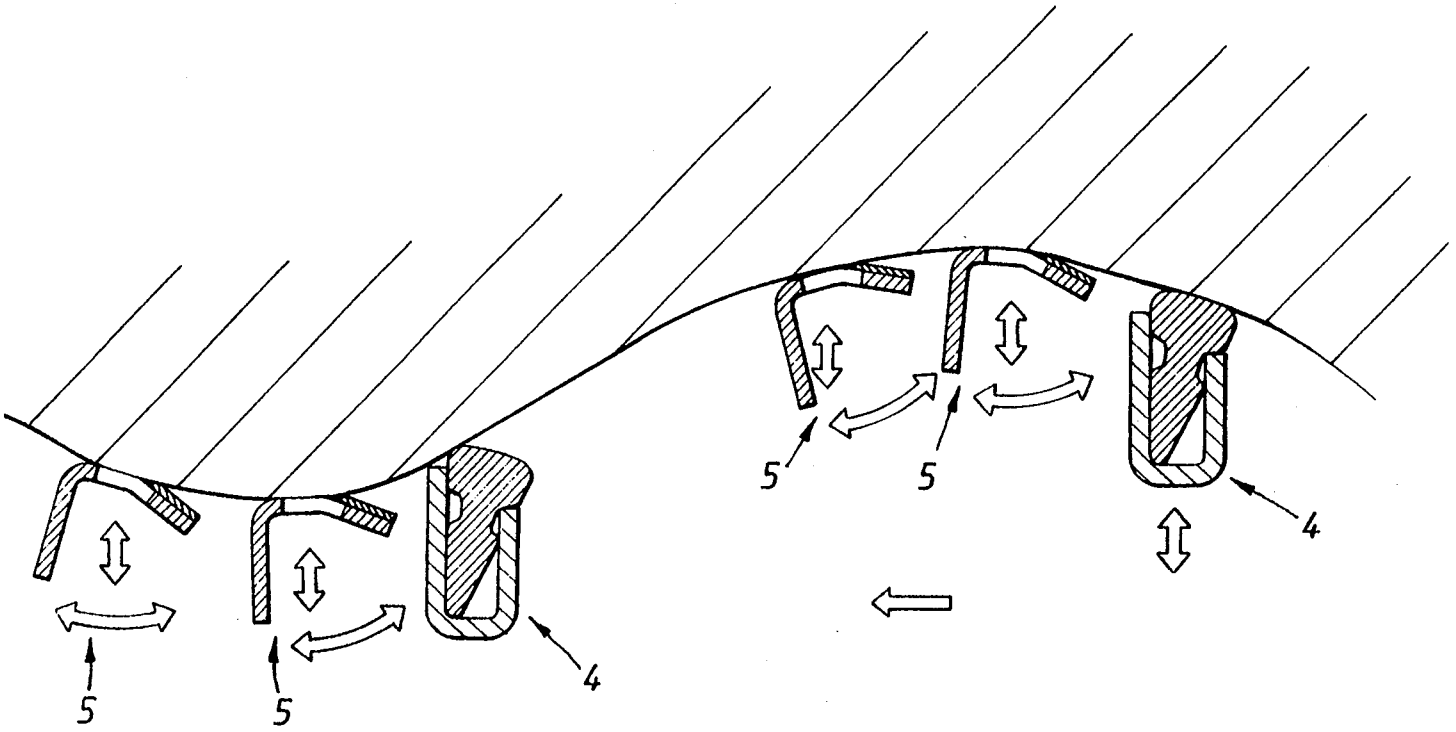
Figure 6:
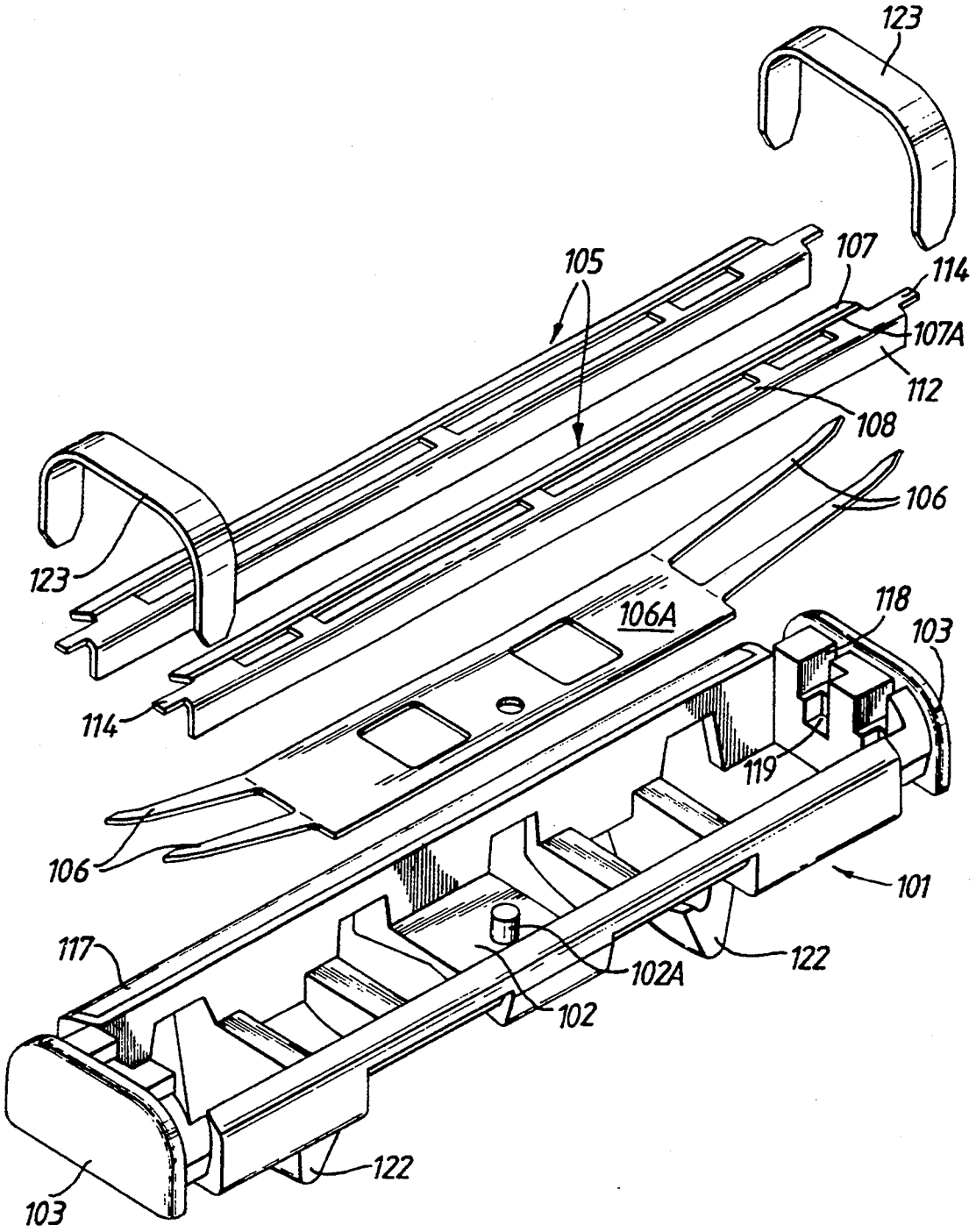
Figure 7:
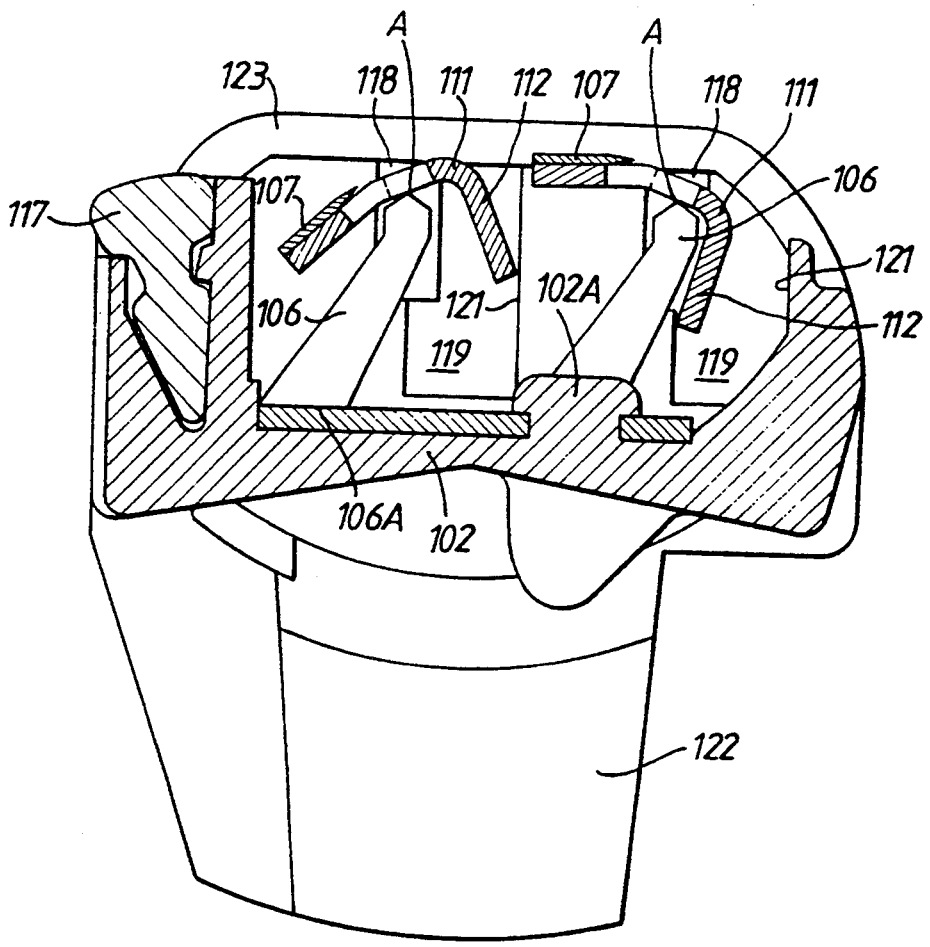

FIG. 4 corresponds with FIG. 3, and shows the parts in different relative positions;

FIG. 5 is a diagrammatic cross-section illustrating different positions of the cap and blade units in use;

FIG. 6 is an exploded perspective view of a modified razor head frame and blade units; and FIG. 7 is a cross-section of the head frame of FIG. 6, corresponding with FIG. 5.

The razor head shown in FIGS. 1 to 4 comprises a metal or moulded plastics head frame 1 having an elongate base 2 and upstanding end walls 3 at opposite ends thereof. Only one end of the frame is shown in these Figs. the opposite end being a mirror image.

The head frame supports a cap member 4, two blade units 5 and three pairs of cantilever wire springs 6, whose inner ends (not shown) are secured to the medial portion of the elongate base.

Each blade unit 5 consists of a narrow blade 7, having a sharpened cutting edge 7A, and a blade support 8 formed as an L-shaped metal stamping to provide a platform 9 and a guard portion providing a curved skin engaging guard surface 11 and a depending leg 12. The support has a slot 13 over most of its length to form a space between the platform 9 and the guard portion and the blade 7 is securely attached to the platform with its edge 7A projecting forwardly into that space, forwardly of the platform.

At its ends, the support 8 is formed with upwardly offset, projecting ears 14 which are abuttingly engaged from below by upstanding end portions 6A of the wire springs 6.

The cap member 4 consists of a channel shaped support 16 in which a cap moulding 17 is secured.

The cap member and blade units are captured at their ends in recesses formed in the end walls 3 of the head frame. More specifically, the ears 14 of the blade supports engage in narrow vertical slots 18 which also receive the vertical end portions 6A of the respective wire springs. Alongside each slot 18 is a shallower, wider recess 19 whose forward face 21 acts as a stop for the adjacent end of the respective leg 12.

Thus, each blade unit is guided for vertical movement in the head frame by engagement of its ears 14 in the slots 18. The springs 6 are pre-stressed so that in the normal, rest position, the blade units are held by the springs in their outermost positions, as shown in FIG. 3. The spring ends 6A are guided and constrained for vertical movement in their respective slots 18 and are pointed at their upper ends, where they engage the ears 14 so as to provide fulcrums, permitting rotational movement of the units about axes parallel with and close to the cutting-edges of the respective blades. As best illustrated in FIG. 4, this rotational movement is limited by engagement of the ends of the legs 12 with the rear faces of slots 18 and the forward faces 21 of recesses 19, respectively. The cap member 4, which is set behind the blade units in the shaving direction, is constrained and guided for vertical movement only, parallel with the corresponding movement of the blade units. The cap member is also urged to its outermost position by its respective wire springs 6, as shown in FIG. 3.

FIG. 4 shows the moving parts in their innermost positions, in which their springs 6 are "bottomed" against the base 2 of the frame.

In use of the razor, the cap and blade units are able to conform closely to the differing contours of the skin areas being shaved by virtue of their being able to move, independently of each other and against the resilient restoring forces of their springs, according to the forces which they experience. This independence of motion is known in itself but, significantly, the blade units are also able to pivot freely in order to permit each unit to maintain close contact with the skin at both its cutting edge 7A and its skin engaging guard surface 11, thus preserving its optimum attitude in spite of variations in the contours of the skin surface. This is due to the fact that the pivotal axis of each unit is parallel with and just ahead of the sharpened edge of the blade.

In FIG. 5, the variations in skin contours are exaggerated to illustrate the way in which the moving parts of the razor accommodate undulations in the skin surface and in particular how the attitudes of the blade units are adjusted automatically to maintain the desired contact with the skin.

The translational movement of the units is described above as being "vertical". This, of course, assumes a specific attitude of the razor head. The sense of the requisite movement, regardless of the attitude of the razor, is transverse to a notional plane containing the blade edge and the skin engaging surface of the guard portion.

Because of the self-guarding nature of the blade units, it will generally be unnecessary to provide a separated guard member, but if one is provided, it can be mounted for translational movement, with a spring suspension, in the same manner as the cap member.

The razor could of course have a single blade unit or three or more if desired, but two units are presently regarded as optimal.

FIGS. 6 and 7 illustrate a modified form of blade unit and head frame which are generally similar to the above described embodiment but with some structural modifications, principally as described below. Parts of the modified embodiment are given reference numerals increased by 100 compared with the numerals used for corresponding parts in the first embodiment.

The blade units 105 are virtually identical with these first described, save that the ears 114 are in the same plane as the guard portion rather than being upwardly offset. As a result the pivotal axis 'A' of the unit is set lower than in the first embodiment.

The moulded head frame 101 is of a different construction, being provided in known manner with depending legs 122 by which the frame is adapted for releasable mounting on the upper end of a razor handle with limited freedom to pivot, relative to the handle, about a longitudinal axis.

The upper surface of the base 102 is formed with an upstanding pip 102A destined to provide an integral rivet for securing a metallic spring member comprising a rectangular medial portion 106A having integral spring fingers 106 extending longitudinally away, and also upwardly from the plane of the portion 106A.

The rear wall of the frame 101 is formed with a channel to receive the cap moulding 117 in a fixed position.

In the end walls 103 of the frame, the slots 118 and recesses 119 are completely open from above and separate clips 123 are provided for retaining the blade units by their ears 114, to the frame.

The function and operation of the blade units is as described above.

I claim:

1. A razor head comprising:

a razor head frame including a unitary molding having an elongated base with upstanding walls at opposite ends thereof, the inner faces of said walls being formed with slots;

at least one blade unit supported in said frame and having:

a blade having a sharpened cutting edge;

a blade support having a platform to which said blade is attached with its edge projecting forwardly of the platform;

an integral guard portion having a skin engaging guard surface spaced forwardly of said blade edge; and mounting means on said blade support by which the integral guard portion and blade are mounted in said frame for rotation together about an axis parallel with and close to said blade edge, said mounting means being received in said slots for substantially vertical movement relative to said frame;

said slots being formed substantially in directions transverse to a notional plane containing said blade edge and said skin engaging surface of said guard portion;

spring means engaging opposite ends of said blade support, said blade support ends being displaceable relative to said frame, said spring means bearing on said elongated base and bearing upwardly at its ends on said mounting means to provide a resilient restoring force; and the inner faces of said walls also being formed with forward and rear abutment faces for engagement by portions of said blade support to limit rotation of said support, wherein said blade unit is substantially vertically movable relative to said frame under forces encountered during shaving, against the resilient restoring force, in directions transverse to the notional plane containing said blade edge and said skin engaging surface of said guard portion.

2. A razor head comprising;

a frame having an elongated base and upstanding side walls disposed on opposite ends of said elongated base, each of said side walls having recesses in their oppositely facing inner surfaces;

at lease one blade unit supported in said frame and having:

a blade with a sharpened cutting edge extending generally parallel to the length of said frame base;

a blade support having a platform for holding said blade and an integral guard portion having a skin engaging guard surface spaced forwardly of said blade edge; and mounting means on said blade support by which the blade and guard portion are mounted in said recesses for rotation together about an axis parallel and close to the said blade edge and for substantially vertical movement within said recesses;

and further including springs disposed on said frame and having a first portion in contact with the said frame and a second portion in contact with said blade unit to bias said blade unit to move relative to the frame in a direction generally perpendicular to the skin engaging surface of the guard portion.

3. A razor head according to claim 2, wherein the said blade support is of generally L-shaped cross-section, having one leg constituting the said platform and a second, depending leg spaced forwardly of the blade edge, the said guard surface being formed by a transitional portion between the legs of the support.

4. A razor head according to claim 2, wherein the said blade support is of generally L-shaped cross-section, having one leg constituting the platform and a second, depending leg spaced from the blade edge for limited rotation about the said axis.

5. A razor head according to claim 2, wherein the support is formed at its opposite ends with a pair of projections, extending beyond respective ends of the said platform and which constitute the said mounting means.

6. A razor head according to claim 2, wherein the said blade support is formed as a unitary metal stamping.

* * * * *